US006629388B2

(12) United States Patent
Cohen

(10) Patent No.: US 6,629,388 B2
(45) Date of Patent: Oct. 7, 2003

(54) PORTABLE GARAGE WITH BALLAST-CONTAINING WALLS

(75) Inventor: Melvin Cohen, Clifton, NJ (US)

(73) Assignee: Handi-Hut Shelters, LLC, Clifton, NJ (US)

( * ) Notice: Subject to any disclaimer, the term of this patent is extended or adjusted under 35 U.S.C. 154(b) by 0 days.

(21) Appl. No.: 10/256,369

(22) Filed: Sep. 27, 2002

(65) Prior Publication Data

US 2003/0024173 A1 Feb. 6, 2003

Related U.S. Application Data

(63) Continuation-in-part of application No. 09/745,128, filed on Dec. 21, 2000, now Pat. No. 6,493,997.

(51) Int. Cl.[7] ..... E04H 6/00
(52) U.S. Cl. ..... 52/79.9; 248/910; 135/116
(58) Field of Search ..... 52/79.9, 79.5, 52/71, 36.4, 36.5, 86, 2.33, 2.22; 135/116; 404/6, 10; 248/910

(56) References Cited

U.S. PATENT DOCUMENTS 1,540,988 A 6/1925 Hensel
2,928,405 A 3/1960 Lawson
3,492,767 A 2/1970 Pincus
4,627,205 A 12/1986 Hitchins
4,856,228 A 8/1989 Robinson
5,208,585 A 5/1993 Sprague
5,295,335 A 3/1994 Collier
5,414,966 A 5/1995 Montoya
5,815,991 A 10/1998 de Ridder
5,846,020 A 12/1998 McKeown
6,493,997 B2 * 12/2002 Cohen ..... 52/79.9

* cited by examiner

*Primary Examiner*—Lanna Mai
*Assistant Examiner*—Jerry A. Anderson
(74) *Attorney, Agent, or Firm*—Siegmar Silber, Esq.

(57) ABSTRACT

The disclosure describes a portable garage with a ballast-containing base. The garage is assembled at a site without physical attachment thereto and disassembled for erection at another site. Each elongated base segment extending along the sidewall of the garage has a cavity therein for receiving ballast which stabilizes the structure. The bases have extensions which interlock and overlie connector portions. Apertures through the connectors have a metal sleeve housing support columns and, upon the sidewall being assembled, these columns are vertically disposed. Between support members a prefabricated roof is attached. The ballast-container is a lightweight, molded plastic construct of high-impact, UV resistant material. The base is equipped with suitable inlet and outlet ports for the addition and removal of ballast.

20 Claims, 7 Drawing Sheets

PORTABLE GARAGE WITH BALLAST-CONTAINING WALLS

REFERENCE TO RELATED APPLICATION

This application is continuation-in-part of application Ser. No. 09/745,128, filed Dec. 21, 2000 now U.S. Pat. No. 6,493,997.

BACKGROUND OF THE INVENTION

1. Field of the Invention

This invention relates to a garage, and, more particularly, to a garage which is readily erected and disassembled and is secured in place by adding ballast, such as water, to cavities at the base of the walls. The structure is designed to be disposed atop a flat surface such as a blacktop driveway or a concrete slab without physical attachment thereto.

2. Description of the Prior Art

In the past, the automobile has been cared for in innumerable creative ways. The romance with the automobile has led to devices and structures ranging from cloth covers tailored, like raincoats to fit the make and model of the automobile, to detached three- and four-car garages, some replete with living quarters for the chauffeur and his spouse. All of these have sought to protect the automobile from the elements—both natural and corrosive—including, of course, sun, precipitation and acid rain, salt air and industrial pollution.

Also, garage construction has usually been dominated by conventional construction methods involving footings or foundations and has paid little attention to the ability of being knocked down and re-erected at another site.

As will be seen in the patent discussion which follows, "Jersey-type" barriers have not been widely adapted to structures. In the solid form, the Jersey barrier has been used for a multilevel roadway structure. In 1987 the ballast-containing form of the Jersey barrier was introduced and the adaptive use thereof includes a highway sign support device.

In preparing for the parent application, several United States patents became known to the inventor hereof. The familiarity resulted from a review of several subclasses of Classes 52, 135, and 404, which review produced the following patents:

| U.S. Pat. No. | Inventor | O.C. | Issue Date |
|---|---|---|---|
| 5,846,020 | McKeown | 404/1 | Dec. 8, 1998 |
| 5,815,991 | de Ridder | 52/88 | Oct. 6, 1998 |
| 5,414,966 | Montoya | 52/66 | May 16, 1995 |
| 5,295,335 | Collier | 52/86 | Mar. 22, 1994 |
| 5,208,585 | Sprague | 340/908.1 | May 4, 1993 |
| 4,856,228 | Robinson | 47/29 | Aug. 15, 1989 |
| 4,627,205 | Hitchins | 52/294 | Dec. 9, 1986 |
| 3,492,767 | Pincus | 52/79 | Feb. 3, 1970 |
| 2,928,405 | Lawson | 135/5 | Mar. 15, 1960 |
| 1,540,988 | Hensel | 49/5 | Jun. 9, 1925 |

McKeown—U.S. Pat. No. 5,846,020

The patent discloses a pre-fabricated reinforced concrete multi-level roadway structure. The structure is erected so as to cover an existing lane on a roadway and is assembled from modules that are cast, transported, and moved, as needed. The cover of the lower roadway forms the roadway of the upper lane with the bottom section thereof consisting of two "Jersey-type" barriers.

Robinson—U.S. Pat. No. 4,856,228 and de Ridder—U.S. Pat. No. 5,815,991

These patents disclose the use of water ballasted, inflatable tunnel systems for pressurized tunnel-type greenhouses. The tunnels are generally semicircular in cross section.

Sprague—U.S. Pat. No. 5,208,585

This patent discloses a portable "Jersey-type" highway barrier constructed of light weight material and has an interior cavity which can be filled with a fluid ballast. The barrier includes vertical slots which support a highway sign.

Pincus—U.S. Pat. No. 3,492,767

This patent discloses a prefabricated building construction including a prefabricated utility core which contains the entire power supply for a building.

Hitchins—U.S. Pat. No. 4,627,205

This patent discloses the associating of a conventional form for in-situ casting of concrete foundations with a pair of sacrificial adjuncts, including reinforcement pins, rods, and hook-bolts.

Hensel—U.S. Pat. No. 1,540,988

This 1923 patent discloses a portable shelter adapted to minimize the effectiveness of aerial bomb attacks. A netting or protective structure is stretched across and arranged to overlie the object to be protected, which netting is supported so as to yield at the moment of impact.

Lawson—U.S. Pat. No. 2,928,405

This patent discloses a lightweight, portable shelter which can be compactly folded up when not in use, and is erectable in various configurations to provide different types of canopies or shades.

Collier—U.S. Pat. No. 5,295,335

This patent discloses a prefabricated shelter which consists of an arched framework having open opposite ends, an anchoring structure for securing the footing of the framework to the ground, and a roof assembly mounted to the top of the arched framework.

Montoya—U.S. Pat. No. 5,414,966

This patent discloses a vehicle enclosure for storing and protecting a vehicle. The enclosure has a base plate and a shell-like cover disposed thereover which, in turn, is hinged to the base plate. A retractable dolly is coupled to the cover with the dolly positionable in a retracted mode for placing the vehicle enclosure in a stowed configuration and in an extended mode for placing the vehicle enclosure in a transportable configuration.

The citing of the above patents is not intended as an admission that any such patent constitutes prior art against the claims of the present application. Applicant does not waive any right to take any action that would be appropriate to antedate or otherwise remove any listed document as a competent reference against the claims of the present application.

Many technical problems relating to surface-mounted portable structures are overcome or resolved by the invention disclosed herein. In contradistinction to the parent case, the method of manufacturing the major components hereof, namely, the vertical-support-holding base connector and the cavity-containing wall base are substantially improved. In the base connector, for example, an open-ended metal sleeve forms the inner part of the base connector mold, and, during manufacture, the sleeve is molded into the base connector. In this application, while the structure described is a portable garage, the same construction techniques are applicable to smaller structures, such as tool sheds and shopping cart corrals. The innovative approach and other improvements over the parent case become apparent in the description which follows.

SUMMARY OF THE INVENTION

The present invention is directed to a portable garage with ballast-containing base. The garage is readily assembled at a chosen site without physical attachment thereto and disassembled for erection at another site. Base segments or portions, which are elongated and extend along the sidewalls of the garage, are configured with a cavity therein. The cavity for receiving ballast is, after the erection of the portable garage, filled with water, sand or gravel. The weight of the ballast stabilizes the structure. The elongated wall bases have extensions or tabs which interlock with a base connector. An aperture through the connector houses a support or column member and, upon the sidewall being assembled and set up, the columns are substantially, vertically disposed. The interposing of the two base portions—one onto the other—is such that the weight of the ballast-containing base is exerted upon the column-receiving base portions. Between the support members a roof is attached. The roof is either prefabricated attaching directly to the support members or is assembled from discrete components mounted on roof beams or trusses which are mounted to the support members.

The ballast-container or wall base has a cavity for receiving ballast and is a lightweight, molded plastic construct of high-impact, UV resistant material. A typical base unit weighs 6 to 7 lbs per linear foot and, typically upon loading with ballast, 80 to 120 lbs. per linear foot. The base is equipped with suitable inlet ports and outlet ports for the addition and removal of ballast, namely, water, sand or gravel. The column base connectors which interlock with the ballast-container wall base are further provided with a metal sleeve or tube insert. In the present embodiment this is a square aluminum tube. Each tube forms the inner portion of the mold used in the manufacture of the base connector. The base connectors, which are manufactured from thermoplastic material, are molded around the sleeves. The sleeves have retainer grooves which, upon the thermoplastic material reaching a molten state, receive the molten material therein. After curing, the sleeves are retained by the base connector. Each base connector is made in a stepped configuration which is overlapped by the upper portion of the wall base.

The upper portion of the base connector has a fixed spline which interlocks with the keyway of the upper portion of the wall base. On the sides adjacent to the fixed spline and on the side opposite the fixed spline, lands are formed permitting the attachment of mountable spline(s) and thereby adapting the connector to a 90°, 180° or T-configuration. The sleeves are designed to accept vertical support members in a telescopic relation therewith. Jacking screws are attached to the lower face of the base connector for levelling purposes, and, upon levelling bring the support members into vertical alignment.

After erecting the portable garage, the ballast containers are filled through the inlet port with a ballast material of choice. Upon disassembly for relocating the structure, the ballast material is removed through the drain port. For ease of handling, the ballast containers nest for compact storage and transport.

OBJECT AND FEATURES OF THE INVENTION

It is an object of the present invention to provide a shelter which is a readily erected and readily disassembled structure.

It is a further object of the present invention to provide a sturdy, free-standing structure that is erectable on a concrete or blacktop surface.

It is yet another object of the present invention to provide a garage structure with ballast-containing walls.

It is still yet another object of the present invention to provide a structure which is erected and disassembled using simple tools, and, upon disassembly, can be readily relocated.

It is a feature of the present invention that the weight of the ballast is sufficient to securely mount the garage structure to the floor.

It is another feature of the present invention to have the ballast-containing wall portions interlockingly engage the column bases so as to provide support and stabilization therefor.

Other objects and features of the invention will become apparent upon review of the drawings and the detailed description which follow.

BRIEF DESCRIPTION OF THE DRAWINGS

In the following drawings, the same parts in the various views are afforded the same reference designators.

DESCRIPTION OF THE PREFERRED EMBODIMENT

Figure 1:
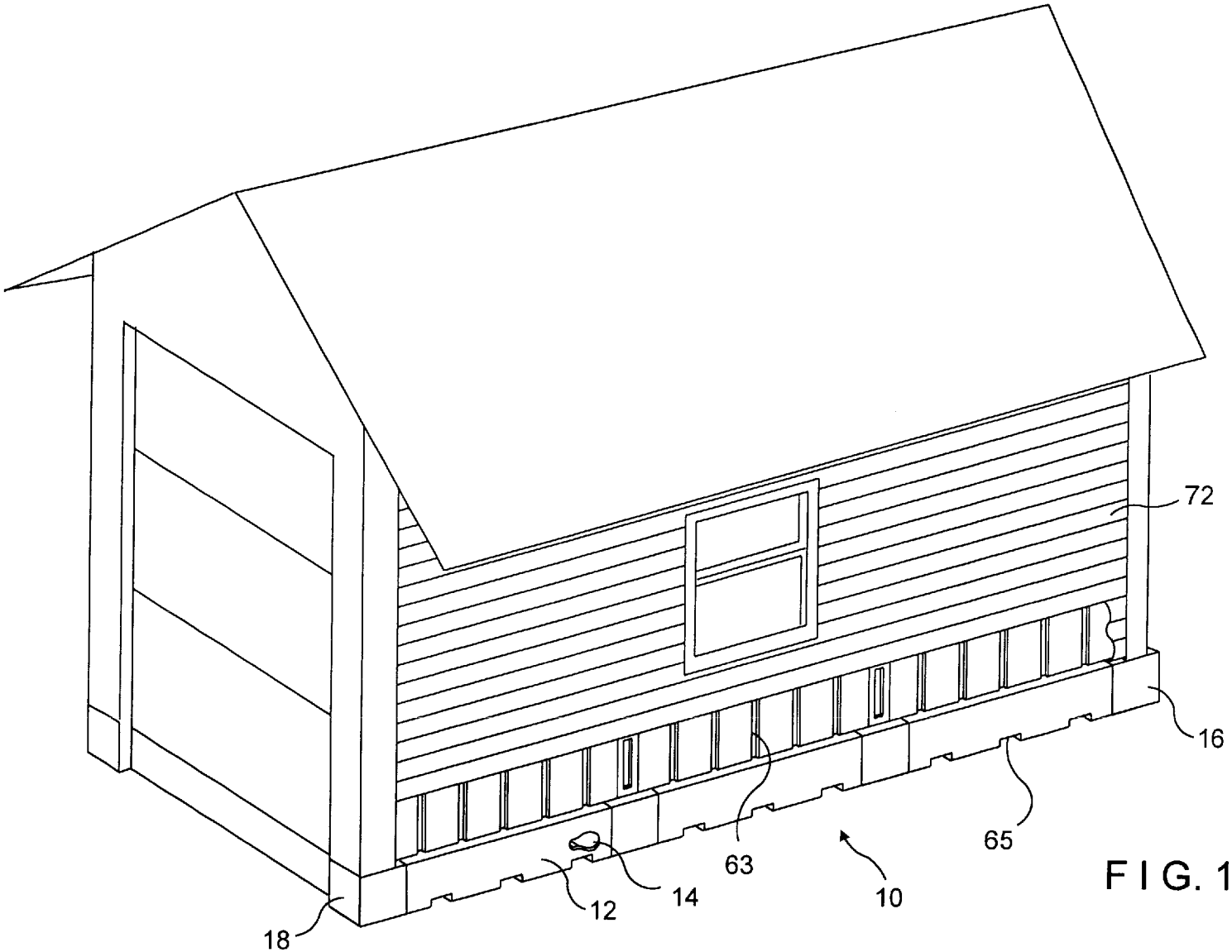
FIG. 1 is a perspective view of the garage with ballast-containing walls of the present invention.
Figure 3:
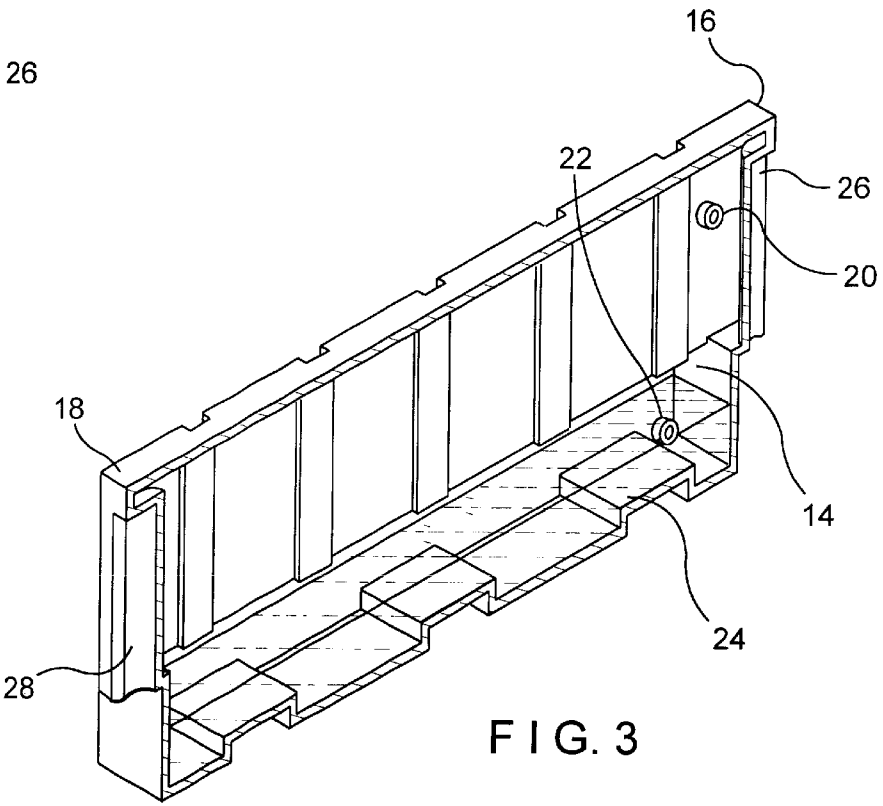
FIG. 3 is a cutaway view of one section of the wall base of FIG. 2 taken line 3—3 of FIG. 2 and showing the ballast chamber with the inlet and outlet ports therefor.
Figure 2:
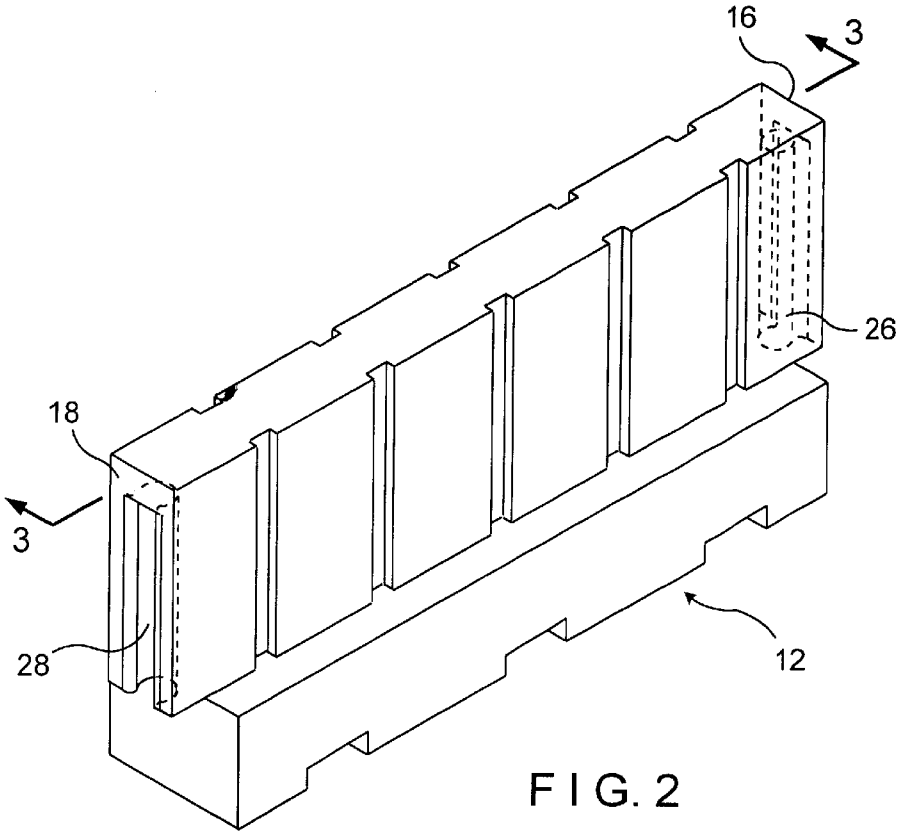
FIG. 2 is a perspective view of one section of the wall base of FIG. 1 partially cut away to show the connecting keyways which overlie the base connectors.

In the description which follows, while the structure described is a portable garage, the same construction technique is applicable to other shelters, such as tool sheds and shopping cart corrals. Referring now to FIGS. 1 through 3, the portable garage with ballast-containing walls is shown and is referred to generally by reference numeral 10. The elongated wall bases 12 are formed from a thermoplastic material which has sufficient structural strength to retain ballast material within the cavity 14 therewithin. The base portion 12 extends at both ends having base connectors 16 and 18 attached thereto. The base connectors 16 and 18, when the elongated wall base 12 is filled with ballast, hold down underlying structural elements and stabilize the overall construct.

The plastic base portion 12 is an adaptation of the Barrier System, manufactured for Barco Products Company, Batavia, Ill. 60510-1961. For receiving ballast into cavity 14 and for removing ballast therefrom, the wall base has a fill port 20 and a drain port 22. Materials suitable for ballast 24 include water, sand and gravel. The present structure is designed for a fluid aqueous ballast. For a dry ballast, minor adjustments are optionally made to adapt the unit to the use of dry ballast. These include, for example, the replacement of the overflow pipe with a bunghole-type arrangement. The keyway portions 16 and 18 also include interlocking keyways or joints 26 and 28, respectively, similar to mortise and tenon joinery, to fit with the adjacent base connector portion described, infra.

In the embodiment shown, both the base connector and the wall base are stepped configurations which fit together so that the upper portion of the wall base overlies the lower portion or steps of the base connector when the upper portions of both units are in a substantially abutting relationship. This occurs when the spline and keyway are interengaged. While the keyway portions here are shown as semicircular indentions in cross-section, any number of shapes may be employed so long as the male and female interlocking portions thereof fit readily one within the other and enable the various subcomponents joined together to be in sliding and locking engagement with each other.

Figure 4:
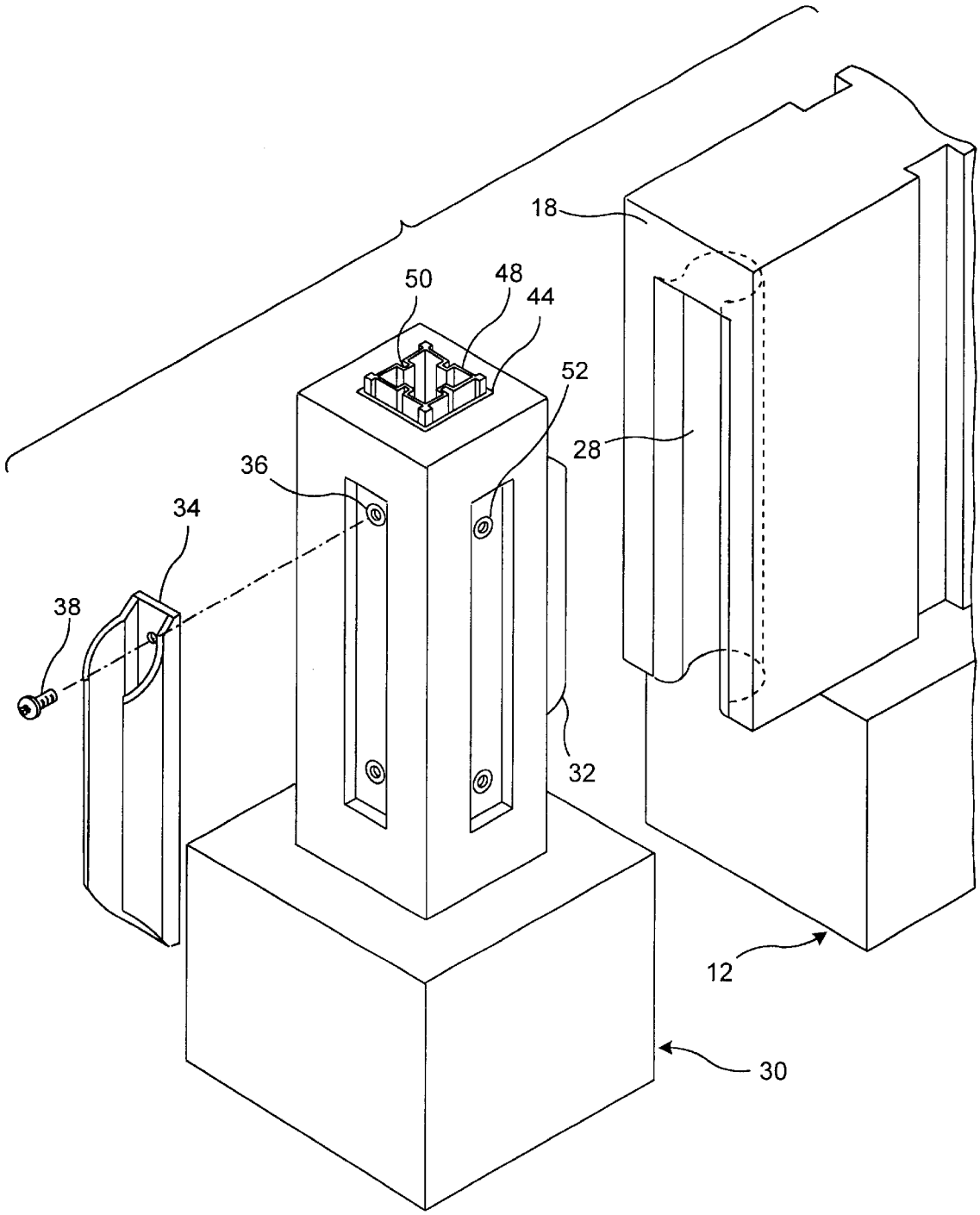
FIG. 4 is a perspective view of the base connector shown with the open-ended sleeve and the vertical support member therewithin and shown with a mountable spline exploded therefrom.
Figure 5:
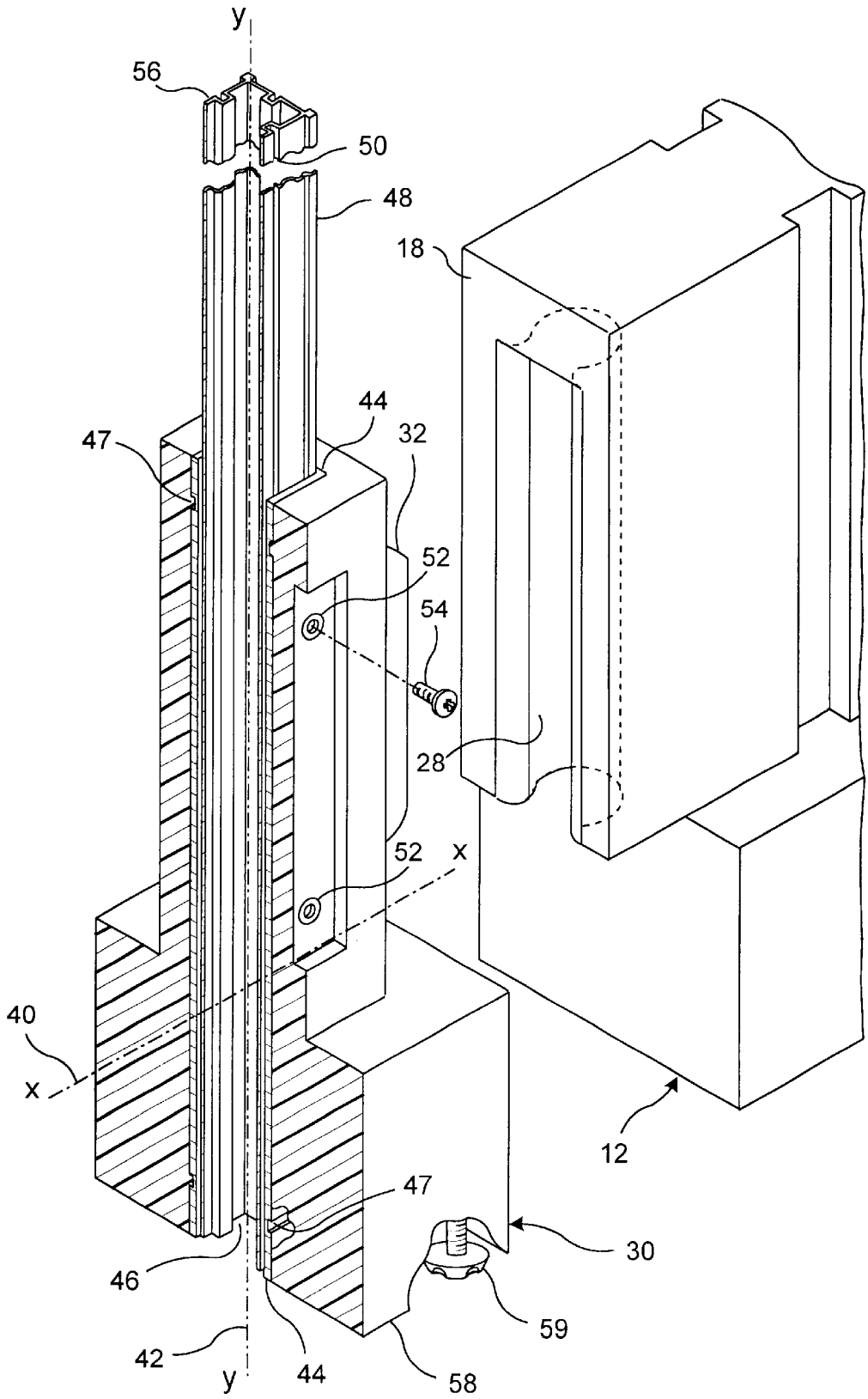
FIG. 5 is a cutaway view of the base connector and vertical support member taken along line 5—5 of FIG. 4 and shows the stepped configuration of the wall base and the base connector.

Referring now to FIGS. 4 and 5 a universal base connector 30 is shown having a male segment or spline 32. Additional male segments 34 and 36 are attachable to base connector 30 using inserts 36 molded into base connector 30 and attaching hardware 38. Relative to x-axis 40 and y-axis 42 as establishing an initial reference plane, these are set at 90°, 180°, and 270°. While a single, universal base connector 30 with attachable male segments 34 is shown, it is within the contemplation of the invention to include a straight connector with premolded male segments at 0° and 180°; T-connectors with premolded male segments at 0°, 90° and 180° or at 0°, 180° and 270°; and L-connectors with male segments at 0° and 90° or at 0° and 270°.

To interlock with joints or splines 26 and 28 corresponding fittings 32 are molded into the connector base and attachable male fittings 24 are employed as required. As shown in this embodiment the joints 26 and 28 are female and the corresponding fittings 32 and 34 are male; however, it is within the contemplation of this invention that fittings 26 and 28 are male and 32 and 34 are female. The base connectors 30 each have an open-ended sleeve 44 within the central bore 46 along longitudinal axis 40 therethrough and, when the portable garage is erected, the longitudinal axis 40 of the central bore 46 is substantially vertical. In the present embodiment, the sleeve 44 is a 3-inch square aluminum tube. During manufacture of the base connectors, the tube 44, which runs throughout the entire height of the base connector 30, forms the interior portion of the mold therefor. The sleeve 44 is captured into the base connector by retainer grooves 47 at both ends of the tube. The thermoplastic material of the base connector upon reaching a molten state flows into grooves 47. After curing, the sleeves are held captive by the base connector 30.

A column or support member 48 is constructed to be retained by the base connector 30. In the example at hand, the opening of the square metal tube 44 is 2¾ inches square (approx.) and is adapted to accommodate support member 48 which is an aluminum extrusion dimensioned so as to telescopically fit within the sleeve. The support member 48 is a four-sided extrusion with a screw boss 50 running longitudinally along each side. The support member 48 is adjustably attached to sleeve 48 by corresponding inserts 52 molded into the base connector 30 and attaching hardware 54. The adjustability enabled by inserting the attaching hardware 54 into a selected position on the screw boss provides for levelling of the upper ends 56 of support members 48. On the lower surface 58 of base connector 30, jacking screws 59 are provided. Upon installation, the use of the jacking screws 59 provides for levelling of the base connector 30 and consequently for truing the support members 48 to vertical alignment.

Figure 6:
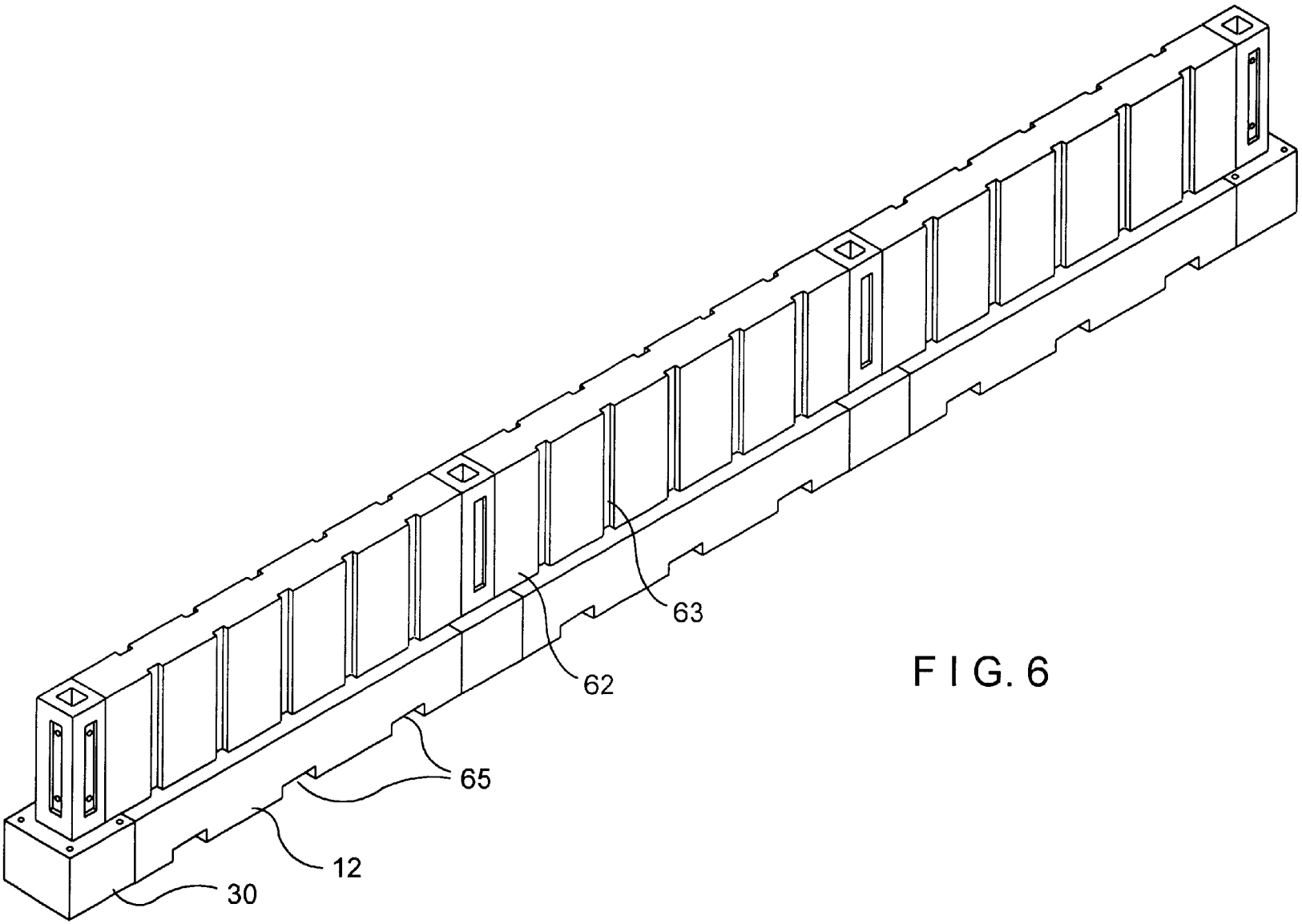
FIG. 6 is a perspective view of three wall bases as in FIG. 2 assembled to four base connectors as in FIGS. 4 and 5.

Referring now to FIG. 6, the elongated wall bases 12 are shown interlocked with the base connector 30. From the illustration, it is seen that the stepped configuration of both components upon installation interlock with one another. The lower portion of base connector 30 extends below the upper portion 62 of elongated wall base 12 and upon ballast 24 being added to cavity 14, locks the structure together. For added rigidity, indents or ribs 63 reinforce and stiffen wall bases 12. For drainage purposes, drainage passages 65 are provided at the bottom of the wall bases 12.

Figure 7:
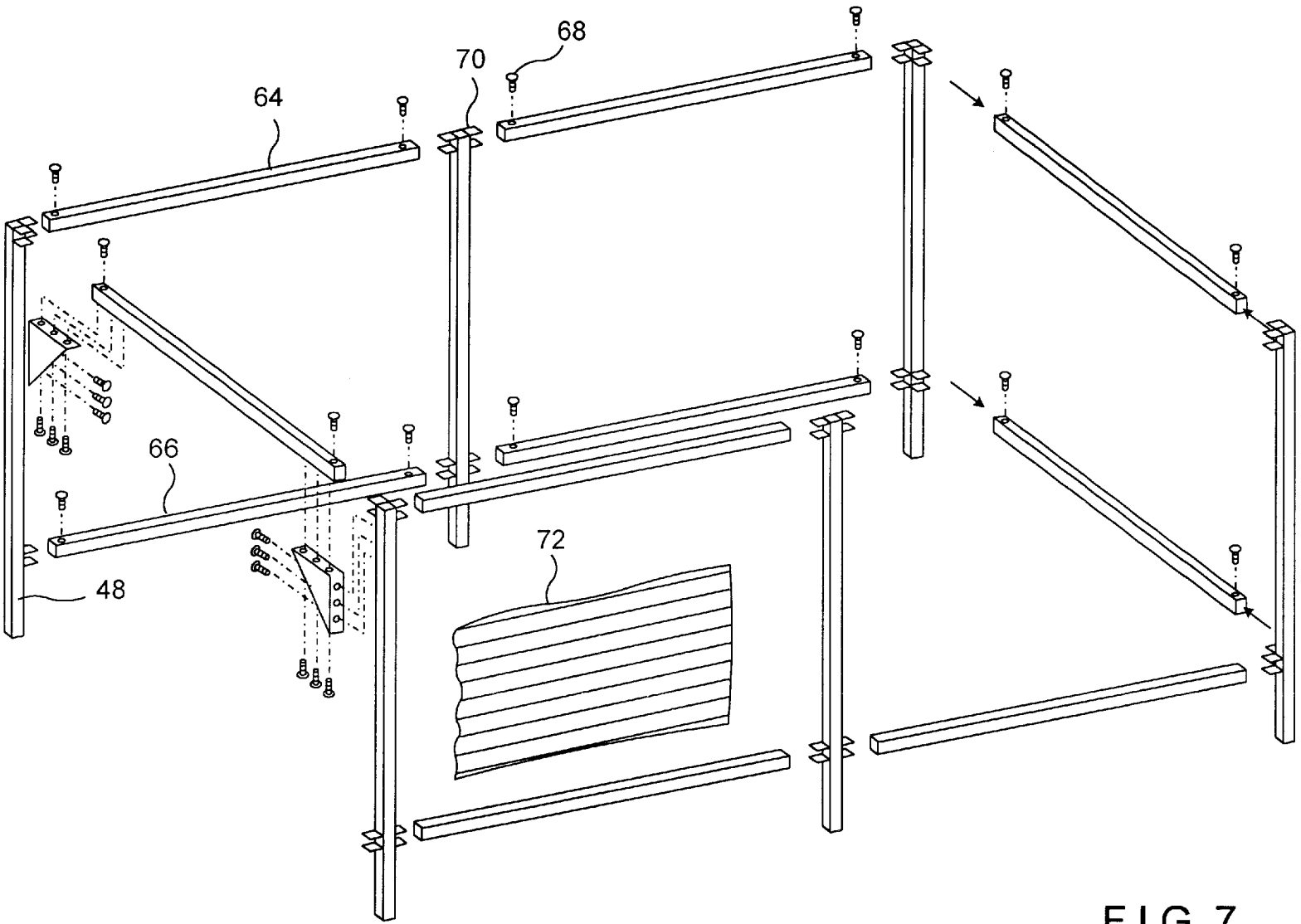
FIG. 7 is a partially exploded view showing the upper framework and the roof support of the invention.

The framing for the walls is completed by horizontal beams or wall caps 64 and intermediate stringers 66, FIG. 7, which beams are preferably of the same construction as the columns 48 and are attached thereto by attaching hardware 68 and 70, respectively. To complete the walls, glazing or prefabricated wall panels 72 are mountable and demountable to and from the framework formed by columns 48, wall caps 64 and stringers 66.

Figure 8:
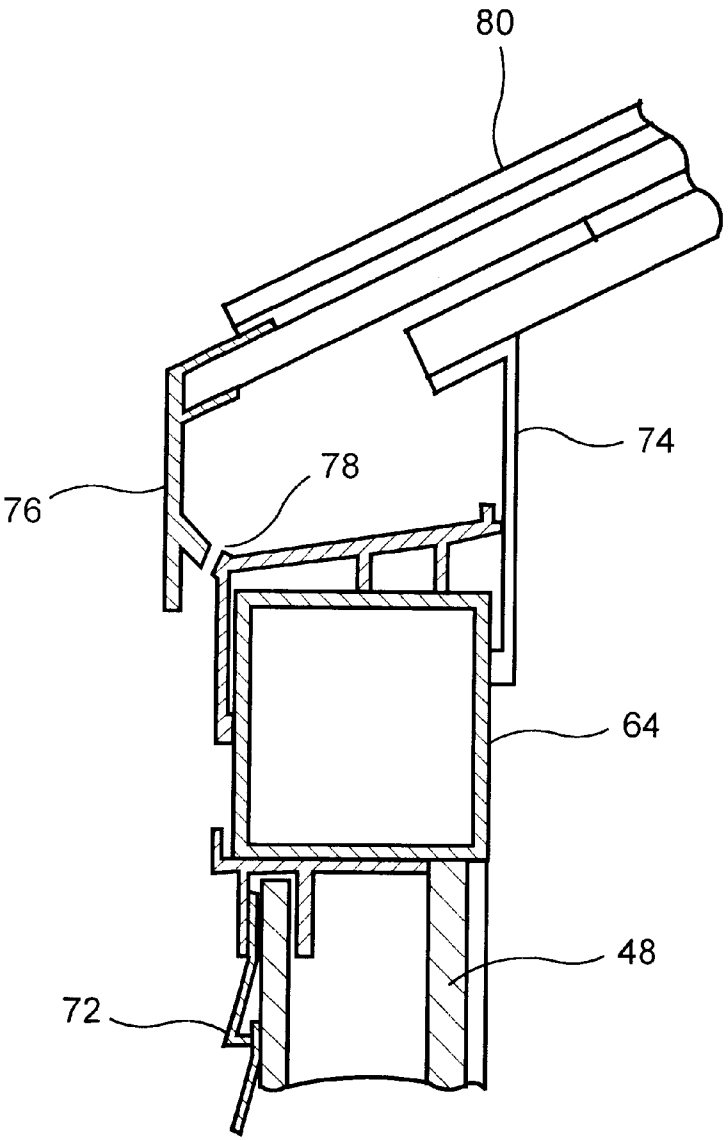
FIG. 8 is a sectional view of the extrusions for the upper wall and roof support structure of this invention.

Atop the wall cap 64, a roof structure is formed using any one of numerous configurations. Typifying such installations is the arrangements shown in FIG. 8. Here an extruded aluminum fascia 74 having an integral gutter 76 is emplaceable upon the wall cap 64. The gutter 76 incorporates weep holes 78 for drainage of water therefrom. As with the wall structure, the roof structure consists of prefabricated roofing panels 80 that are readily mountable and demountable to and from the upper framework. Depending upon the roof configuration selected additional roof supports may be added as required.

In the construction of the portable garage, the assembly and, conversely, the disassembly is accomplished with simple hand tools such as a screwdriver and a wrench. First a site is selected or formed having a relatively flat surface or with a slope maintaining, after adjustment of the support members, the horizontal disposition of the wall caps. The emplacements of the base portions and the universal base connectors are established and interconnected. The wall framing elements together with the roof fascia components are next laid out and connected on the ground. The lower ends of the columns are inserted through the base connectors and attached loosely to the flanged collars. The wall units are then righted to a vertical alignment and interconnected with the adjacent walls. The columns about the garage are next adjusted so that the desired alignment of the roof line is achieved. With the base frame completed the prefabricated wall panels and roofing components are attached. The ballast cavities are next filled with water so as to provide the necessary weighting of the unit. The construction is thus completed without any foundation therebelow or attachment thereof to footing at the site.

The disassembly and erection of the portable shelter at another site proceeds by essentially reversing the erection procedure described above. After emptying the ballast cavities, the garage components are moved to the new site, the erection procedures are followed, and the ballast is replenished.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A portable garage mountable on the surface of a site, said portable garage for protecting an automobile parked therein comprising:

two or more wall bases having a lower face adapted for emplacement on said surface, each of said wall bases being hollow and adapted to receive ballast therewithin, and having an upper portion with an extending longitudinal part extending beyond said lower face thereof;

a plurality of base connectors, each adjacent to one of said wall bases and extending below said extending longitudinal part of said one of said wall bases, each of said base connectors disposed, upon ballast being added to said adjacent one of said wall bases, to be held down thereby;

a plurality of open-ended metal sleeve members, each of said sleeve members in one of said base connectors, each said one of said sleeve members, upon erection of said portable garage, extending substantially vertically through the respective one of said base connectors;

a plurality of support members each disposed in one of said open-ended sleeve members, said support members for supporting walls and a roof structure;

a roof extending between said support members adapted to protect said automobile parked thereunder; and whereby, upon filling one or more of said first base portions with ballast, the structure becomes stabilized without an excavated foundation.

2. A portable garage as described in claim 1 wherein said base connectors are molded of a thermoplastic material and each of said sleeve members forms an interior portion of a mold therefor.

3. A portable garage as described in claim 2 wherein said sleeve members further comprise retainer grooves thereabout, said retainer grooves, upon said sleeve members acting as a mold, adapted to receive molten thermoplastic material therewithin and thereby, upon said thermoplastic material curing to a rigid state, said sleeve members are captive in said base connectors.

4. A portable garage as described in claim 3 wherein said sleeve members are metal tubes and extend vertically through said base connectors and, when erected, each lower end of each said sleeve members are coplanar with said lower face of corresponding one of said base connector.

5. A portable garage as described in claim 1 wherein each of said base connectors further comprises:

an upper portion;

a spline for interconnecting a wall base to said upper portion; and, wherein said extending longitudinal part of each of said wall bases further comprises:

a keyway for accepting said spline therewithin.

6. A portable garage as described in claim 5 wherein each of said base connectors has two splines mounted 180° apart to accept two wall bases of the same wall.

7. A portable garage as described in claim 5 wherein each of said base connectors has two splines mounted 90° apart, each for accepting one of said wall bases of adjacent walls.

8. A portable garage as described in claim 5 wherein each of said base connectors has three splines mounted 90° apart, each for accepting one of said wall bases in a T-arrangement.

9. A portable garage as described in claim 5 wherein each of said base connectors has four splines mounted 90° apart, for accepting up to four of said wall bases.

10. A portable garage as described in claim 5 wherein said spline is mountable to and demountable from said corresponding one of said base connectors.

11. A portable garage as described in claim 5 wherein said one of said base connectors further comprises:

a fixed spline molded thereinto;

three lands adapted for mounting one or more additional splines at 90° and 180° from said fixed spline.

12. A portable shelter mountable on the surface of a site, said portable shelter assembled from interlocking components for assemblage on said site and for disassemblage and re-assemblage on another site, said portable shelter for protecting an automobile comprising:

a wall base with a lower face adapted for emplacement on said surface of said site, said wall base being an elongated body molded from a thermoplastic material and having a cavity therewithin adapted to receive ballast, said wall base, in turn, comprising:

an upper wall base portion having extensions extending longitudinally beyond said lower face;

a keyway in said extension of said upper wall base portion adapted to interlock with a spline-containing component;

a base connector having a stepped configuration molded from a thermoplastic material and, when placed in an abutting relation with said wall base, said upper wall base portion is adapted to overhang a step of said base connector, said base connector, in turn, further comprising:

an upper base connector portion having a spline molded thereinto, said spline adapted to interlock with said keyway of said wall base;

an open-ended sleeve member molded into and substantially vertically disposed within said base connector; and, a support member disposed in said sleeve member and adapted to support wall and roof components;

whereby, upon filling said wall base with ballast the structure becomes stabilized without an excavated foundation.

13. A portable shelter as described in claim 12 wherein said upper base connector is substantially square in cross-section with said molded spline protruding from one face thereof and attachment sites on the remaining faces adapted for mountable additional splines; and wherein said sleeve member is a square metal tube with the sides thereof parallel to said faces of said upper base connector portion.

14. A portable shelter as described in claim 13 wherein said support member is in telescopic relation to said sleeve member and is attachable thereto, and wherein said portable shelter further comprises a screw boss along the length and central to each face of said support member enabling the adjustable attachment to said sleeve member;

one or more mountable splines adapted for mounting at selected ones of said attachment sites adjacent to and opposite of said molded spline enabling a 90° corner and a straight wall connector arrangement, and a T-connector arrangement.

15. A portable shelter as described in claim 12 wherein said base connector further comprises a plurality of jacking screws mounted on said lower surface thereof, said jacking screws threadably engageable to level said base connector and, where said support member in telescopic relation with said base connector to bring said support member into vertical alignment.

16. A shopping cart corral mountable on the surface of a site, said shopping cart corral assembled from interlocking components for assemblage on said site and for disassemblage and re-assemblage on another site, said shopping cart corral for gathering shopping carts therewithin comprising:

a wall base with a lower face adapted for emplacement on said surface of said site, said wall base being an elongated body molded from a thermoplastic material and having a cavity therewithin adapted to receive ballast, said wall base, in turn, comprising:

an upper wall base portion having extensions extending longitudinally beyond said lower surface;

a keyway in said extension of said upper wall base portion adapted to interlock with a spline-containing component;

a base connector having a stepped configuration molded from a thermoplastic material and, when placed in an abutting relation with said wall base, said upper wall base portion is adapted to overhang a step of said base connector, said base connector, in turn, further comprising:

an upper base connector portion having a spline molded thereinto, said spline adapted to interlock with said keyway of said wall base;

an open-ended sleeve member molded into and substantially vertically disposed within said base connector; and, a support member disposed in said sleeve member and adapted to support wall and roof components;

whereby, upon filling said wall base with ballast the structure becomes stabilized without an excavated foundation.

17. A shopping cart corral as described in claim 16 further comprising a roof attached to said support member adapted to protect said shopping carts gathered thereunder.

18. A shopping cart corral as described in claim 16 wherein said upper base connector is substantially square in cross-section with said molded spline protruding from one face thereof and attachment sites on the remaining faces adapted for mountable additional splines; and wherein said sleeve member is a square metal tube with the sides thereof parallel to said faces of said upper base connector portion.

19. A shopping cart corral as described in claim 18 wherein said support member is in telescopic relation to said sleeve member and is attachable thereto, and wherein said shopping cart corral further comprises:

a screw boss along the length and central to each face of said support member enabling the adjustable attachment to said sleeve member;

one or more mountable spline adapted for mounting at selected ones of said attachment sites adjacent to and opposite of said molded spline enabling a 90° corner, a straight wall connector arrangement, and a T-connector arrangement.

20. A shopping cart corral as described in claim 16 wherein said base connector further comprises a plurality of jacking screws mounted on said lower surface thereof, said jacking screws threadably engageable to level said base connector and, where said support member in telescopic relation with said base connector to bring said support member into vertical alignment.

* * * * *